US009995030B1

(12) United States Patent
Jimenez

(10) Patent No.: US 9,995,030 B1
(45) Date of Patent: Jun. 12, 2018

(54) SPILL REDUCING TOILET WATER RETAINING MAT

(71) Applicant: Keith A. Jimenez, Denver, CO (US)

(72) Inventor: Keith A. Jimenez, Denver, CO (US)

( * ) Notice: Subject to any disclaimer, the term of this patent is extended or adjusted under 35 U.S.C. 154(b) by 0 days. days.

(21) Appl. No.: 15/281,647

(22) Filed: Sep. 30, 2016

Related U.S. Application Data

(60) Provisional application No. 62/310,283, filed on Mar. 18, 2016.

(51) Int. Cl.

| | |
|---|---|
| ***D06F 39/08*** | (2006.01) |
| ***F16K 23/00*** | (2006.01) |
| ***E03D 11/13*** | (2006.01) |
| ***B65D 1/34*** | (2006.01) |
| ***B65D 25/28*** | (2006.01) |

(52) U.S. Cl.
CPC ..... *E03D 11/135* (2013.01); *B65D 1/34* (2013.01); *B65D 25/2823* (2013.01); *Y10T 137/5762* (2015.04)

(58) Field of Classification Search
CPC ..... E03D 11/135; B65D 1/34; B65D 25/2823; Y10T 137/5762
See application file for complete search history.

(56) References Cited

U.S. PATENT DOCUMENTS

| | | | | |
|---|---|---|---|---|
| 2,152,719 A | | 4/1939 | Williams | |
| 2,758,316 A | | 8/1956 | Schwarz et al. | |
| 3,102,654 A | * | 9/1963 | Millman | F24F 13/22 134/58 D |
| 5,184,653 A | * | 2/1993 | Lacy | E03D 11/00 141/231 |
| 5,309,579 A | | 5/1994 | Nelson | |
| 5,492,372 A | | 2/1996 | Dranberg | |
| 6,094,752 A | | 8/2000 | Loshaw | |
| 6,378,141 B1 | | 4/2002 | Lew | |
| 6,446,275 B1 | * | 9/2002 | Wright | A47G 27/0206 4/251.1 |
| 7,165,275 B2 | | 1/2007 | Clark | |
| 7,231,674 B1 | * | 6/2007 | Cernik | B62B 1/26 280/47.17 |
| 7,753,071 B2 | * | 7/2010 | Wood | G01M 3/16 137/312 |
| 8,313,130 B2 | * | 11/2012 | Hazel | E03D 11/135 294/144 |
| 9,091,048 B2 | * | 7/2015 | Arthurs | E03D 11/135 |
| 2015/0001869 A1 | * | 1/2015 | Arthurs | E03D 11/135 294/144 |
| 2017/0167126 A1 | * | 6/2017 | Arthurs | E03D 11/135 |

* cited by examiner

*Primary Examiner* — Mary McManmon
*Assistant Examiner* — Kevin Barss
(74) *Attorney, Agent, or Firm* — Aaron R. Cramer; Cramer Patent & Design PLLC

(57) ABSTRACT

A retaining mat is suitably sized to stabilize a toilet while the toilet is being replaced or installed. The mat prevents damage to adjacent tile, carpet, wood, or other flooring during toilet replacement. The mat includes an encircling retaining lip so as to form a catch basin to receive any water which may escape from the toilet.

16 Claims, 3 Drawing Sheets

SPILL REDUCING TOILET WATER RETAINING MAT

RELATED APPLICATIONS

The present invention was first described in and claims the benefit of U.S. Provisional Application No. 62/310,283 filed Mar. 18, 2016, the entire disclosures of which are incorporated herein by reference.

FIELD OF THE INVENTION

The present invention relates generally to a mat suitably sized to stabilize a toilet while the toilet is being replaced or installed and protect the flooring during installation or removal.

BACKGROUND OF THE INVENTION

As anyone who has ever installed or replaced a toilet will attest, it is tiring work. Workers not only must contort their body into small cramped locations, but also deal with stubborn fittings, leaky connections, rusted fasteners, and heavy toilet bowls and tanks. The odd shape of a toilet bowl coupled with protruding bottom fittings mean that the toilet bowl is wobbly and unstable before it is put into place.

For example, should it topple over, costly damage to the bowl and surrounding surfaces is likely. Additionally, a large amount of water is often present from toilet bowls that are removed. This water is very likely to leak out and damage carpeting, wood floors, and the like. Accordingly, there exists a need for a means by which a toilet bowl can be removed and replaced without the disadvantages as described above. The development of the mat fulfills this need.

SUMMARY OF THE INVENTION

The inventor has recognized the aforementioned inherent problems and lack in the art and observed that there is a need for a spill reducing toilet water retaining mat.

It is therefore an object of the invention to provide a mat, comprising a plate which has a top face, a bottom face and a retaining lip. The retaining lip comprises a first, second, third and fourth sidewall. The first, second, third and fourth sidewalls are joined along all abutting horizontal edges of the plate. The mat also comprises a stabilizer which is disposed on the top face and a catch basin which is defined by the retaining lip and the plate. The interior diameter of the stabilizer is configured to restrain a sanitary fixture when placed upon the mat. In an alternate embodiment, each first, second, third and fourth sidewall slope inwardly towards the plate from top to bottom.

An elongated handle may be attached to the top face, adjacent to a top face edge. A pair of fastener recesses may be incorporated within the plate which conceal a pair of fasteners which are used to attach the handle to the plate. The handle further comprises a cylindrical "C"-shaped rod comprising non-corrosive metal. The stabilizer may be disposed along a center line of a first bisecting axis while being offset from an exact center of the top face. The stabilizer may further comprise a circular disk which is configured to project into a drain aperture of a toilet. The retaining lip may be approximately a one-and-a-half inch (1½ in) vertical projection. The plate, stabilizer and retaining lip may be made of a rigid thermoplastic.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
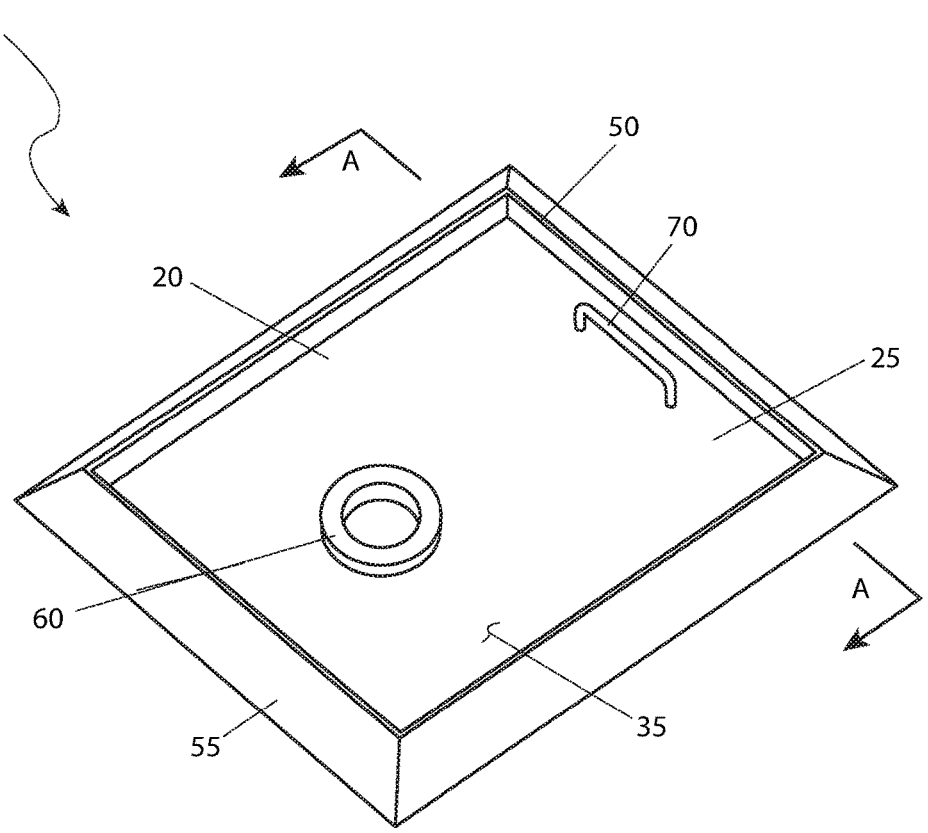
FIG. 1 is an isometric view of a sanitary closet mat 10 in accordance with the preferred embodiment of the present invention; and, FIG. 2 is a section view long line A-A as seen in FIG. 1 of the sanitary closet mat 10 in accordance with the preferred embodiment of the present invention.

10 sanitary closet mat
20 plate
25 front
30 bottom face
35 top face
40 catch basin
50 retaining lip
55 side
60 stabilizer
70 handle
75 handle fastener
80 fastener recess
85 grip
90 toilet

DETAILED DESCRIPTION OF THE PREFERRED EMBODIMENT

Figure 2:
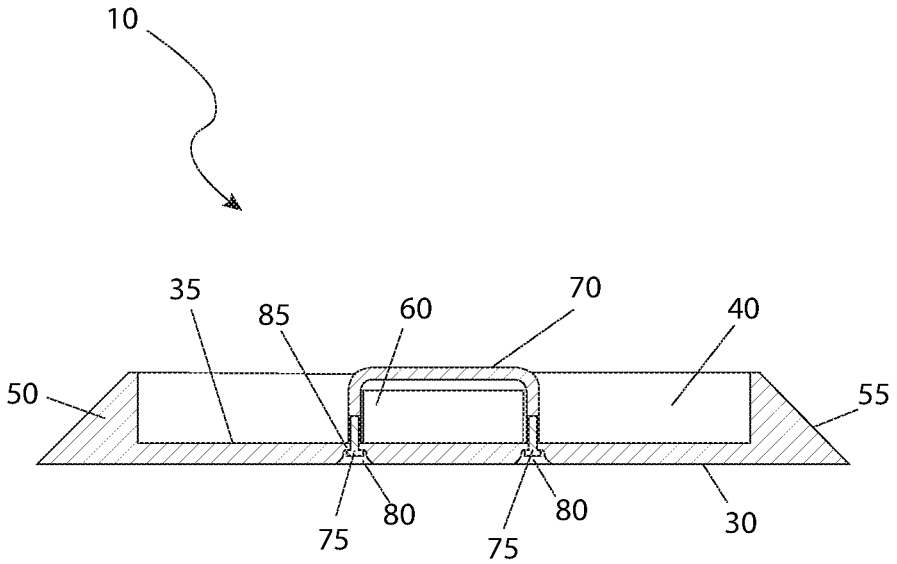
Figure 3:
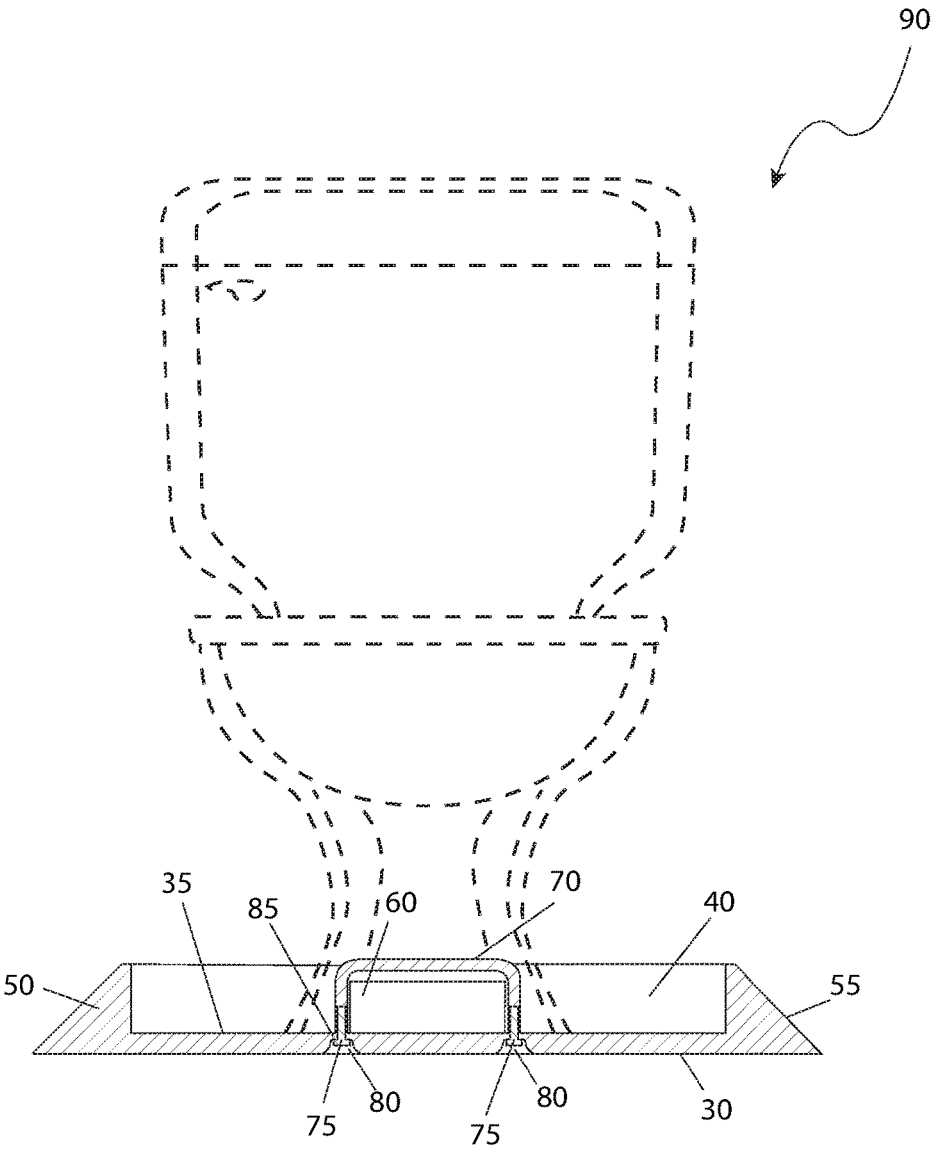
FIG. 3 is a section view long line A-A as seen in FIG. 1 of the sanitary closet mat 10 with a toilet bowl 90 (not depicted in FIG. 1) positioned upon stabilizer 60 in accordance with the preferred embodiment of the present invention

The best mode for carrying out the invention is presented in terms of its preferred embodiment, herein depicted within FIGS. 1 through 3. However, the invention is not limited to the described embodiment, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and only one (1) particular configuration shall be shown and described for purposes of clarity and disclosure and not by way of limitation of scope.

The terms "a" and "an" herein do not denote a limitation of quantity, but rather denote the presence of at least one (1) of the referenced items.

The present invention describes a sanitary closet mat (herein referred to as the "device") 10, which provides a fixture upon which a toilet, having been removed from service for any reason, may be temporarily placed so as to provide a stable support platform for that toilet 90 and a catch basin 40 to collect any fluid that may drain therefrom.

Referring now to FIG. 1, an isometric view, FIG. 2, a section view along line A-A as seen in FIG. 1, of the device 10, and FIG. 3, is a section view long line A-A as seen in FIG. 1 of the sanitary closet mat 10 with a toilet bowl 90 (not depicted in FIG. 1) positioned upon stabilizer 60 in accordance with the preferred embodiment of the present invention, is disclosed. The device 10 includes a plate 20 with a stabilizer 60, and a retaining lip 50 forming a catch basin 40. The retaining lip 50 and the plate 20 are composed of a rigid thermoplastic which may be constructed from an injection-molded part. The plate 20 is configured to be a planar rectangle approximately one-and-a-half inches (1½ in.) thick having the vertical sides 55 slope inwardly approximately forty-five degrees (45°) from a bottom face 30 to a top face 35. The plate 20 is provided with a retaining lip 50 joined along all abutting horizontal edges. The retaining lip 50, configured to be an approximate one-and-a-half inch (1½ in.) vertical projection around the periphery of the plate 20, is disposed upon the top face 35 of the plate 20. The retaining lip 50 forms the vertical boundary of the catch basin 40 and is intended to prevent any fluid draining from the toilet 90 from running off the edge of the plate 20.

An elongated, "U"-shaped handle 70 is attached to the plate 20 in proximity to an edge. This handle 70 defines the front 25 of the catch basin 40 as the handle 70 is located in closer proximity to this front 25. The handle 70 is generally a cylindrical "C"-shaped rod composed of a metal having a coating, or plating, to inhibit corrosion and formed into the desired configuration. Other materials, such as thermoplastics, or composites, as well as other cross-sectional shapes, may be utilized without limiting the scope of the device 10. The ends of the handle 70 are provided with threaded apertures (not specifically shown) for the insertion of and retention by, threaded handle fasteners 75 as illustrated in FIG. 2. A portion of the plate 20 may be raised to incorporate fastener recesses 80 as shown in FIG. 2 so as to eliminate the undesirable projection of the handle fasteners 75 from the underside of the device 10. The fastener recesses 80 are configured to be cylindrical indentations of the plate 20 within the bottom face 30 with an incorporation of a grip 85 at the top face 35, having an aperture (not specifically shown) to accommodate the shank of the handle fastener 75.

A stabilizer 60 is also disposed on the top face 35 of the plate 20. The stabilizer is an annular disk of thermoplastic formed with, or subsequently attached to, the plate 20 for securing the position of a sanitary closet to the device 10. The interior diameter of the stabilizer 60 is sufficient to restrain a sanitary fixture, such as a toilet 90, placed upon the device 10 and is preferably three-and-five-eighth inches (3⅝ in.). The outside diameter is preferably five-and-three-eighth inches (5⅜ in.). A standard in the industry is to have a circular drain aperture in the bottom of the fixture. The toilet 90 is intended to be installed with the stabilizer 60 encircling this drain aperture so as to obviate any tipping of the fixture. The stabilizer is located centrally along a longitudinal axis of the device 10 and positioned so that the edge is approximately ten inches (10 in.) from that edge of the interior of the retaining lip 50 which is opposite from the handle 70. See FIG. 3

In accordance with the invention, the illustrated embodiment can be utilized by an enabled individual in a simple and straightforward manner with little or no training. After initial purchase or acquisition of the device 10, it would be arranged as indicated in FIG. 1. The method of installing and utilizing the device 10 may be achieved by performing the following steps: acquiring a model of the device 10; placing the device 10 at a convenient location adjacent to the work area at which the sanitary closet is to be removed; following the correct procedure for the disassembly and removal of the sanitary closet; placing the toilet bowl 90 of the sanitary closet upon the top face 35 of the plate 20 of the device 10 with the drain aperture of the fixture surrounded by the stabilizer 60; allowing any fluid draining from the sanitary closet to enter the catch basin 40; affecting the repair as necessary; removing the toilet bowl 90 from the device 10 and completing the installation and reconnection of the sanitary closet.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

What is claimed is:

1. A mat, comprising:
- a plate, having a top face and a bottom face;
- an elongated handle attached to said top face adjacent to an edge thereof;
- a pair of fastener recesses incorporated within said plate to conceal a pair of fasteners to attach said handle to said plate;
- a retaining lip comprising:
  - a first sidewall;
  - a second sidewall;
  - a third sidewall; and,
  - a fourth sidewall;
  - wherein said first sidewall, said second sidewall, said third sidewall and said fourth sidewall are joined along all abutting horizontal edges of said plate;
- a stabilizer disposed on said top face; and,
- a catch basin defined by said retaining lip and said plate;
- wherein an interior diameter of said stabilizer is capable to restrain a sanitary fixture placed upon said mat.

2. The mat of claim 1, wherein said handle further comprises a cylindrical C-shaped rod comprising non-corrosive metal.

3. The mat of claim 1, wherein said stabilizer is disposed along a center line of a first bisecting axis and offset from an exact center of said top face.

4. The mat of claim 3, wherein said stabilizer further comprises a circular disk, configured to project into a drain aperture of a toilet.

5. The mat of claim 4, wherein said stabilizer comprises a rigid thermoplastic.

6. The mat of claim 1, wherein said retaining lip is approximately a 1½ inch vertical projection.

7. The mat of claim 6, wherein said retaining lip comprises a rigid thermoplastic.

8. The mat of claim 1, wherein said plate comprises a rigid thermoplastic.

9. A mat, comprising:
- a plate, having a top face and a bottom face;
- an elongated handle attached to said top face adjacent to an edge thereof;
- a pair of fastener recesses incorporated within said plate to conceal a pair of fasteners to attach said handle to said plate;
- a retaining lip comprising:
  - a first sidewall, inwardly sloping towards said plate from bottom to top;
  - a second sidewall, inwardly sloping towards said plate from bottom to top;
  - a third sidewall, inwardly sloping towards said plate from bottom to top; and, a fourth sidewall, inwardly sloping towards said plate from bottom to top;

wherein said first sidewall, said second sidewall, said third sidewall and said fourth sidewall are joined along all abutting horizontal edges of said plate;

a stabilizer disposed on said top face; and, a catch basin defined by said retaining lip and said plate;

wherein an interior diameter of said stabilizer is capable to restrain a sanitary fixture placed upon said mat.

10. The mat of claim 9, wherein said handle further comprises a cylindrical C-shaped rod comprising non-corrosive metal.

11. The mat of claim 9, wherein said stabilizer is disposed along a center line of a first bisecting axis and offset from an exact center of said top face.

12. The mat of claim 11, wherein said stabilizer further comprises a circular disk, configured to project into a drain aperture of a toilet.

13. The mat of claim 12, wherein said stabilizer comprises a rigid thermoplastic.

14. The mat of claim 9, wherein said retaining lip is approximately a 1½ inch vertical projection.

15. The mat of claim 14, wherein said retaining lip comprises a rigid thermoplastic.

16. The mat of claim 9, wherein said plate comprises a rigid thermoplastic.

* * * * *